US007592960B2

(12) United States Patent
Byrne et al.

(10) Patent No.: US 7,592,960 B2
(45) Date of Patent: Sep. 22, 2009

(54) HIGH FREQUENCY CAPACITIVE COUPLING ANTENNA FOR VEHICLES

(75) Inventors: Steven V. Byrne, Goodrich, MI (US); Randall J. Heidtman, Columbiaville, MI (US); Loren M. Thompson, Lapeer, MI (US)

(73) Assignee: Delphi Technologies, Inc., Troy, MI (US)

( * ) Notice: Subject to any disclaimer, the term of this patent is extended or adjusted under 35 U.S.C. 154(b) by 282 days.

(21) Appl. No.: 11/633,715

(22) Filed: Dec. 5, 2006

(65) Prior Publication Data

US 2008/0129618 A1 Jun. 5, 2008

(51) Int. Cl.
*H01Q 1/32* (2006.01)

(52) U.S. Cl. ..... 343/713; 343/711; 343/872

(58) Field of Classification Search ..... 343/713, 343/872, 700 MS, 711
See application file for complete search history.

(56) References Cited

U.S. PATENT DOCUMENTS

| | | | | |
|---|---|---|---|---|
| 3,403,395 | A | 9/1968 | Gundry et al. | |
| 5,438,697 | A | 8/1995 | Fowler et al. | |
| 6,023,243 | A * | 2/2000 | Frank | 343/700 MS |
| 2003/0197651 | A1 * | 10/2003 | Yuanzhu | 343/725 |
| 2006/0109178 | A1 * | 5/2006 | Takeuchi et al. | 343/700 MS |

FOREIGN PATENT DOCUMENTS

| | | |
|---|---|---|
| EP | 1 610 410 | 12/2005 |
| EP | 1 624 527 | 2/2006 |
| EP | 1 633 015 | 3/2006 |

OTHER PUBLICATIONS

European Search Report dated Apr. 9, 2008.
Mostafa Hedayatnia et al: "An Antenna Combined With a Shock Absorber (Elastomer Material)" Motorola Technical Developments, Motorola Inc. Schaumburg, Illinois, US. vol. 11, Oct. 1, 1990, p. 104, XP000178643 ISSN: 0887-5286.

* cited by examiner

*Primary Examiner*—Trinh V Dinh
*Assistant Examiner*—Dieu Hien T Duong
(74) *Attorney, Agent, or Firm*—Jimmy L. Funke

(57) ABSTRACT

An antenna system includes a detachable assembly including a circuit board that is connected to a cover by a resilient member. A bezel is adhesively attached to the glass of a vehicle having conductive antenna elements on the vehicle glass. The bezel includes guide surfaces and locating surfaces that accurately position the circuit board and antenna feed wire relative to the vehicle glass. The cover and circuit board can be detached from the bezel for servicing of the circuit board, and the guide and locating surfaces of the bezel provide for accurate positioning of a replacement detachable upper assembly during servicing/repair of the antenna system.

16 Claims, 6 Drawing Sheets

HIGH FREQUENCY CAPACITIVE COUPLING ANTENNA FOR VEHICLES

TECHNICAL FIELD

The present invention is generally directed to an antenna system, and, more specifically, to a high frequency capacitive coupling antenna including a unique mounting arrangement that provides for accurate positioning of antenna components during both initial installation/assembly and during servicing of the antenna.

BACKGROUND OF THE INVENTION

High frequency antennas have been developed for use on vehicles to receive signals such as a radio signal from a satellite. Such antennas may include a thin layer of conductive material disposed on an inner side of the vehicle glass utilizing an etching process or other suitable process. An electrical circuit board and antenna feed wire are positioned directly adjacent the conductive element. The antenna feed wire is spaced apart from the conductive element on the glass surface and it may be encapsulated by a dielectric material. Proper operation of the antenna requires precise positioning of the antenna feed wire relative to the conductive element on the glass surface. The need to provide precise mounting of the antenna feed wire has led to difficulties in manufacture and servicing of the antenna. For example, if one of the electrical components on the circuit board fails replacement of the circuit board may be difficult because positioning of a new circuit board and antenna feed wire in the field may be quite difficult.

Accordingly, an antenna arrangement alleviating these difficulties would be beneficial.

SUMMARY OF THE INVENTION

One aspect of the present invention is a high frequency capacitive coupling antenna system for motor vehicles. The antenna system includes a generally planar conductive antenna element adapted to be fixed to a non-conductive component of a vehicle. A bezel includes a mounting surface configured to fixedly position the bezel relative to a surface of a non-conductive vehicle component and relative to the conductive antenna element. The bezel further includes a support surface configured to support and position an electrical circuit board. The circuit board assembly includes a board structure and a plurality of electrical circuit elements mounted to the board structure. The antenna system further includes an antenna feed wire electrically connected to the electrical circuit elements. At least a portion of the feed wire extends away from the circuit board towards the conductive antenna element. The antenna feed wire is spaced apart from the conductive antenna element, and does not directly contact the conductive antenna element. The antenna system further includes a dielectric material encapsulating the antenna feed wire. A housing is removably connected to the bezel, and a resiliently compressible member is secured to the housing and positioned between the circuit board and the housing. The circuit board is secured to the resiliently compressible member, and the resiliently compressible member biases the circuit board into contact with the support surface of the bezel and thereby positions the circuit board and antenna feed wire relative to the bezel.

Another aspect of the present invention is an antenna system for vehicles including a bezel having a mounting surface, guide surfaces. and at least one support surface. Adhesive disposed on the mounting surface provides for mounting of the bezel to window glass of a vehicle. The antenna system further includes a circuit board having electrical circuit elements mounted to a board structure. An antenna feed wire extends from the circuit board, and dielectric material encapsulates at least a portion of the antenna feed wire. At least a selected one of the circuit board and the dielectric material contact the mounting surface of the bezel to thereby position the antenna feed wire relative to the mounting surface of the bezel.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which:

FIG. 1;

FIG. 1;

DESCRIPTION OF THE PREFERRED EMBODIMENTS

Figure 1:
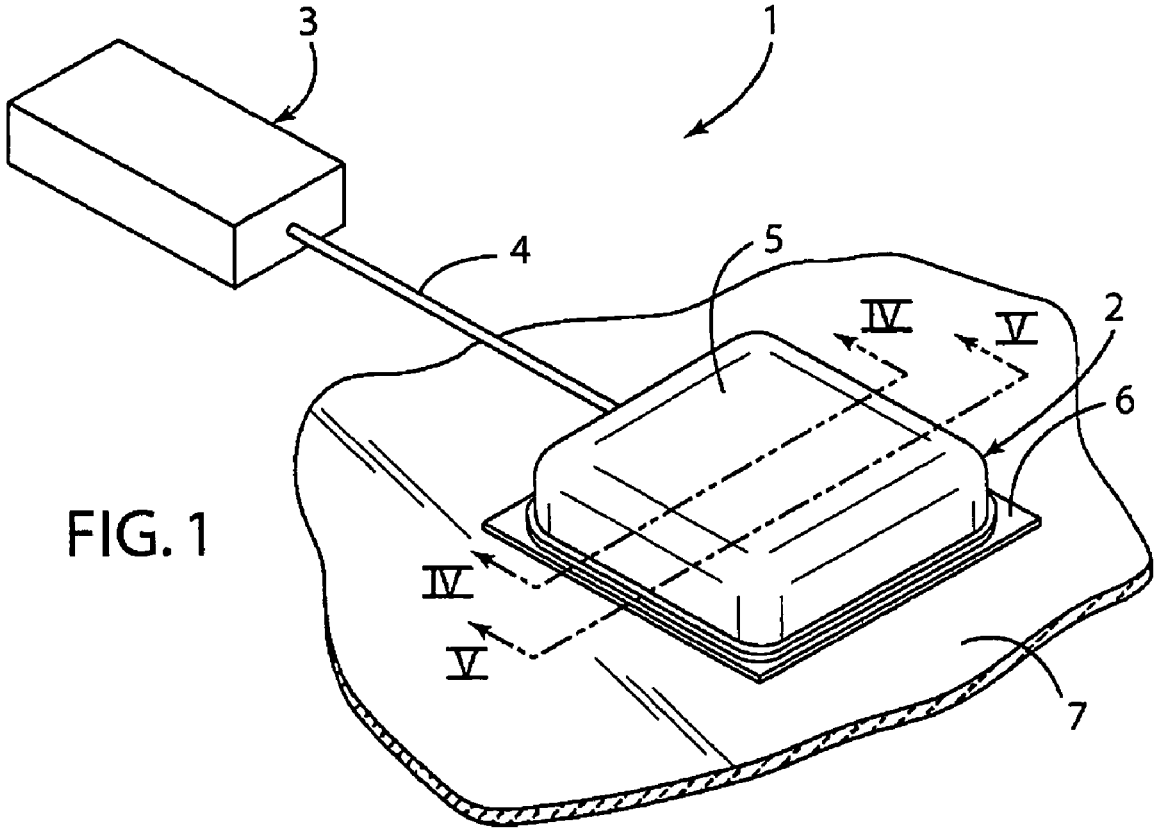
FIG. 1 is a partially fragmentary isometric view of a high frequency capacitive coupling antenna system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1 a high frequency capacitive coupling antenna system 1 according to one aspect of the present invention includes an electrical unit 2 that is electrically connected to a conventional connector 3 via a coaxial cable 4. The connector 3 connects to the electrical system (not shown) of a motor vehicle. The electrical unit 2 includes a cover or housing 5 chat is attached to a bezel 6 that is adhesively bonded to the interior surface of a vehicle glass window component 7. A conductive antenna element 8 (see FIG. 2) is disposed on the vehicle interior glass surface 7 directly adjacent and "below" the bezel 6. It will be understood that antenna system 1 is typically oriented upside down or at an acute angle relative to a horizontal plane, and the terms "above", "below" and the like merely refer to the orientations shown in the figures.

Figure 2:
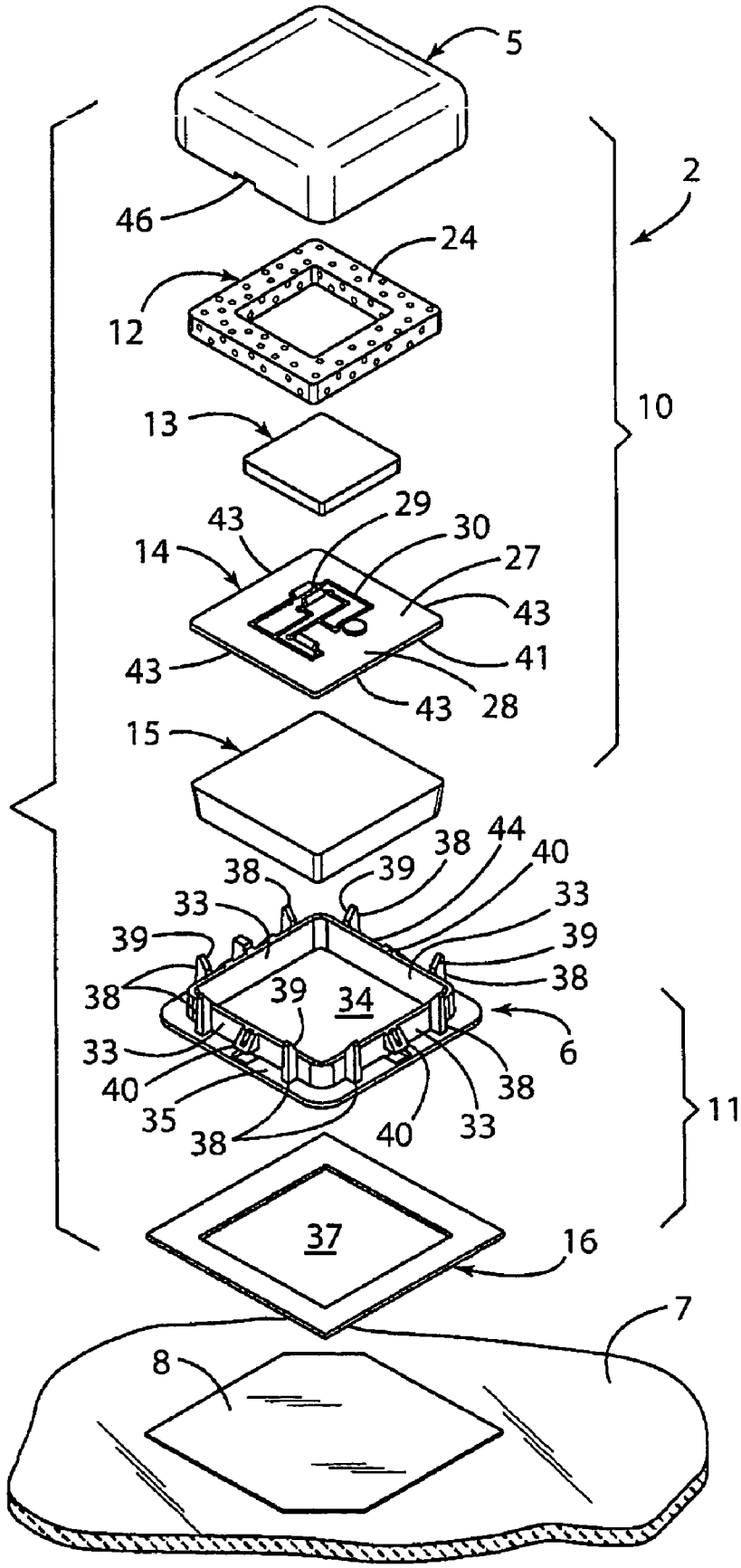
FIG. 2 is an exploded isometric view of the antenna system of FIG. 1.
Figure 3:
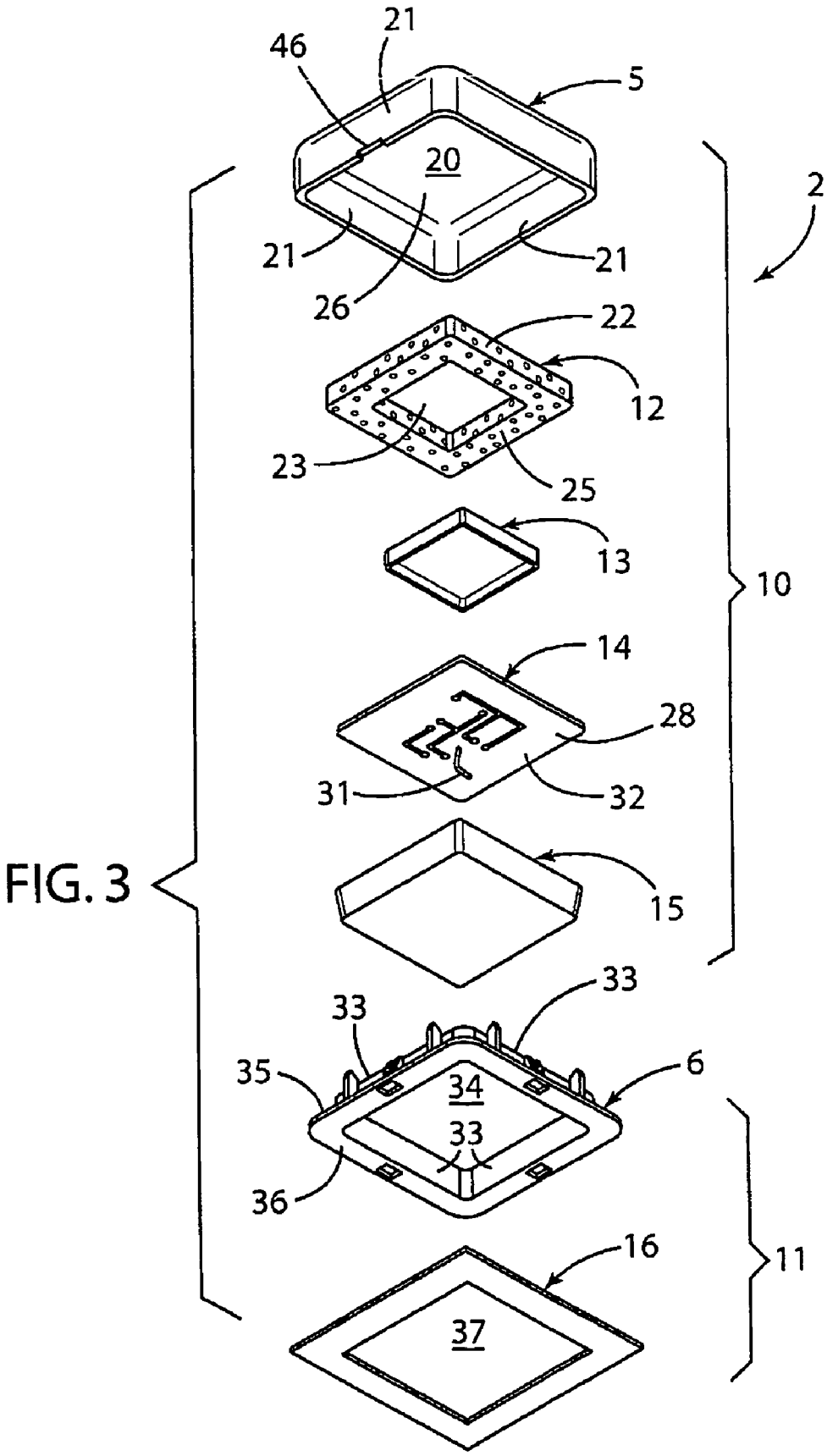
FIG. 3 is an exploded isometric view of the antenna system of FIG. 1 from a different angle than that of FIG. 2.
Figure 4:
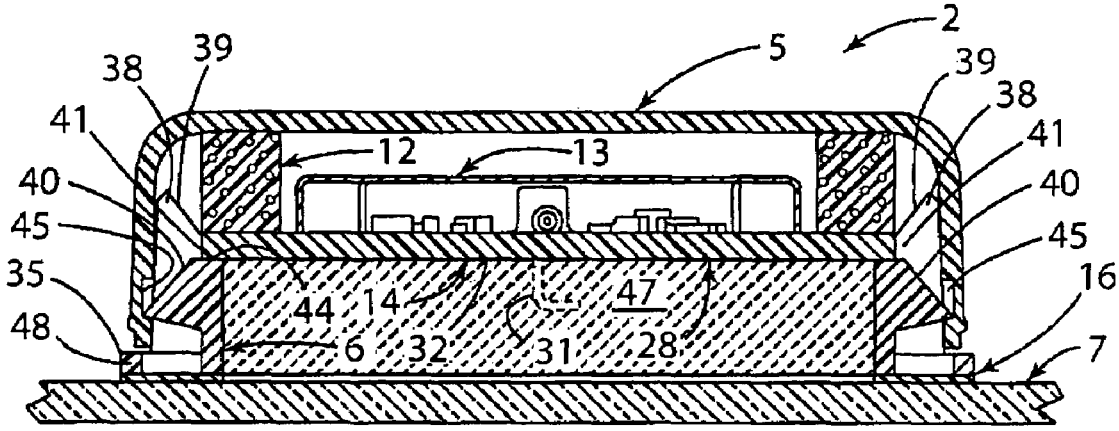
FIG. 4 is a cross-sectional view of the antenna system taken along the line IV-IV.
Figure 5:
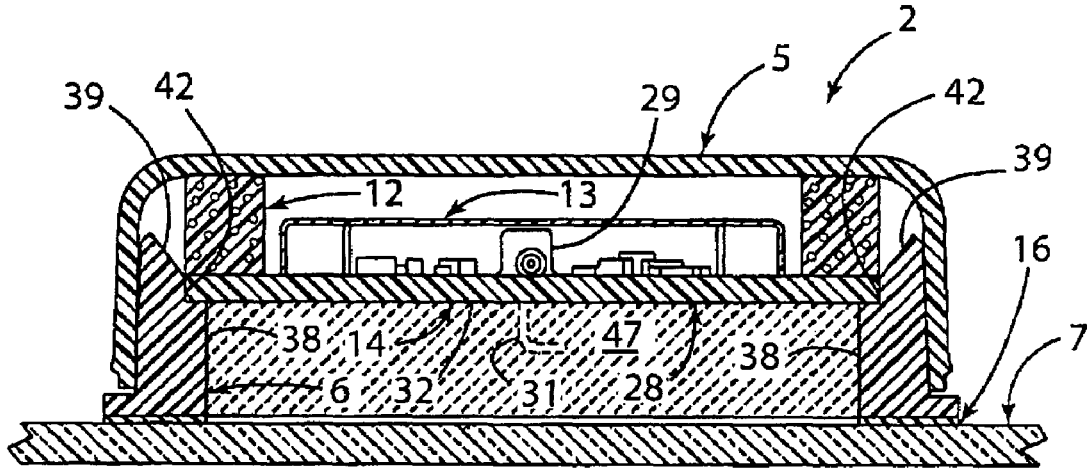
FIG. 5 is a cross-sectional view of the antenna system taken along the line V-V.
Figure 6:
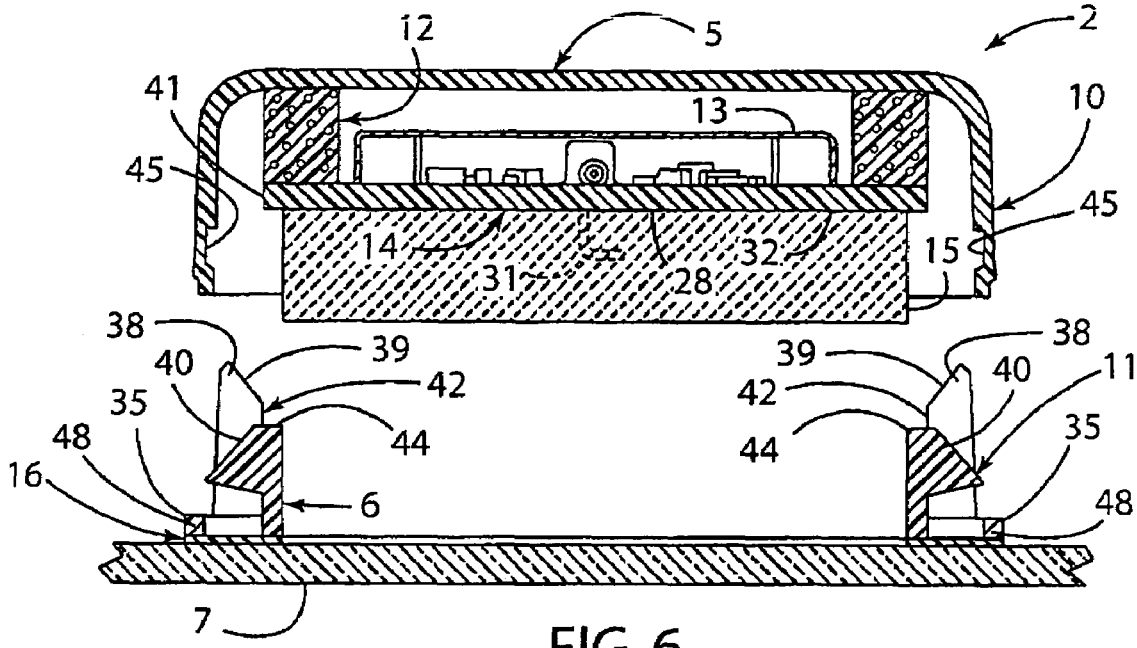
FIG. 6 is a partially exploded view of the antenna system of FIG. 4 wherein the detachable upper assembly is detached from the bezel assembly.
Figure 7:
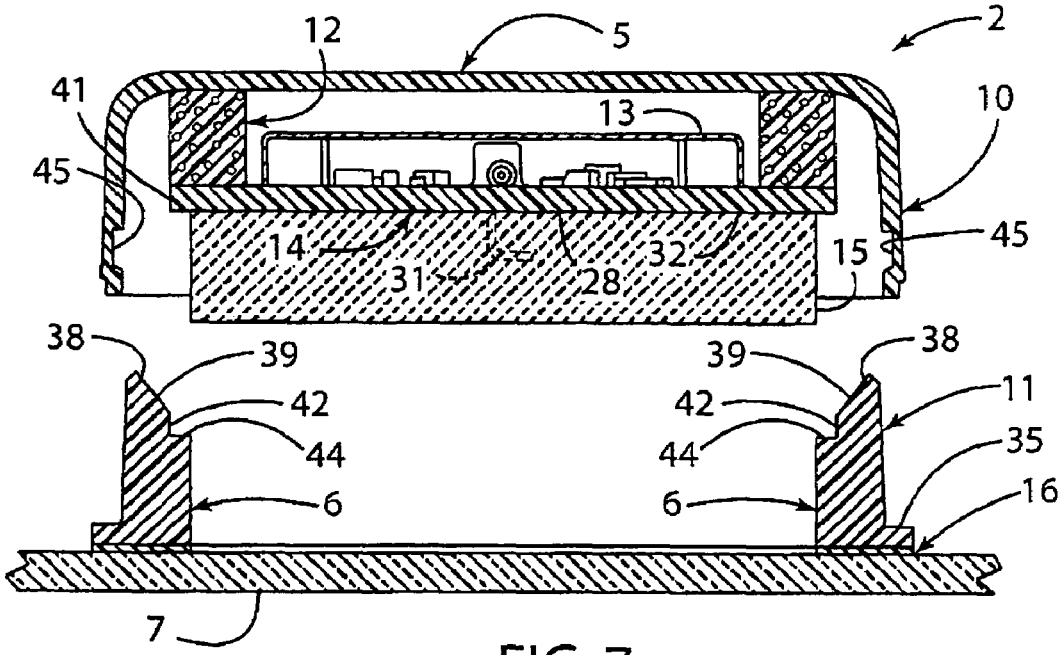
FIG. 7 is a partially exploded view of the antenna system of FIG. 5 wherein the detachable upper assembly is detached from the bezel assembly.

With further reference to FIGS. 2 and 3, electrical unit 2 comprises a detachable upper assembly 10, and a bezel assembly 11 (see also FIGS. 6 and 7). The detachable upper assembly 10 includes cover 5, foam retainer 12, shield 13, circuit board assembly 14 and dielectric member 15. An antenna feed element such as conductive wire 31 extends downwardly from circuit board 14 and capacitively couples with conductive element 8. Antenna feed wire element 31 is fixed to a circuit board 28 of circuit board assembly 14. Proper positioning of antenna wire element 31 relative to conductive antenna element 8 on glass 7 can therefore be accomplished by properly positioning circuit board 28 relative to glass 7.

Accurate positioning of antenna feed wire 31 relative to conductive antenna element 8 is important for antenna performance. In the illustrated example, the allowable variation in the position of feed wire 31 relative to conductive antenna element 8 in a direction normal to the plane of antenna element 8 is less than 0.25 mm. The allowable variation in side-to-side positioning of feed wire 31 in the plane of antenna element 8 is 2.00 mm.

Bezel assembly 11 includes bezel 6 and adhesive pad or layer 16 that secures bezel 6 to vehicle glass 7. As described in more detail below, the bezel assembly 11 is adhesively bonded to the vehicle glass 7 in a permanent manner, and upper assembly 10 detachably connects to bezel assembly 11. As also described in more detail below, upper assembly 10 detaches from bezel assembly 11 to permit repair/replacement at a vehicle service center or the like, and the connecting arrangement between the upper assembly 10 and the bezel assembly 11 locates the circuit board 14 and antenna feed wire 31 of upper assembly 10 relative to bezel assembly 11 and relative to the conductive antenna elements 8 on the vehicle glass 7. Accurate positioning of antenna feed wire 31 of upper assembly 10 relative to the conductive antenna element 8 ensures that the antenna system 1 operates correctly.

Cover 5 includes a wall or web 20, and sidewalls 21 extending perpendicularly from the web 20. Foam retainer 12 has a square or quadrilateral outer perimeter 22, and an enlarged square opening 23 through a central portion of the foam retainer 12. The upper surface 24 (FIG. 2) and the lower surface 25 (FIG. 3) have adhesive disposed thereon to secure the foam retainer 12 to the inner surface 26 of cover 5, and to upper surface 27 of circuit board 28.

Circuit board assembly 14 includes circuit board 28. and a plurality of electrical components 29 and conductive elements 30. In the illustrated example, circuit board 28 includes four side edge portions 43 that form a quadrilateral outer peripheral edge 41. The antenna feed wire 31 (FIG. 3) is electrically connected to the electrical components 29 of circuit board assembly 14. and the antenna feed wire 31 extends downwardly away from lower surface 32 of circuit board 28. The electrical circuit components 29 and antenna feed wire 31 are of a known design utilized for high frequency capacitive antennas, such that these components will not be described in detail herein. Shield 13 is made of tinned cold-rolled steel, and shield 13 is soldered to the circuit board assembly 14 to ground the shield 13 and secure the shield 13 to the circuit board assembly 14. When assembled, antenna feed wire 31 is encapsulated by dielectric material or member 15.

In the illustrated example, bezel 6 of bezel assembly 11 includes four sidewall portions 33 that together define a quadrilateral opening 34 through a central portion of the bezel 6. A flange 35 extends outwardly away from sidewalls 33. The lower surface 36 (FIG. 3) of flange 35 forms a mounting surface that fits closely against glass 7 when the electrical unit 2 is installed on vehicle glass 7. Bezel 6 includes a plurality of guide/support members 38 that extend outwardly away from sidewalls 33. As described in more detail below, guide/support members 38 include tapered end surfaces 39 that guide circuit board 28 of detachable upper assembly 10 into position on the bezel assembly 11 both during initial assembly and during servicing after the vehicle has been in use. Bezel 6 includes a plurality of snap connectors 40 that detachably interconnect cover 5 and bezel 6. Adhesive pad 16 has a quadrilateral shape forming an opening 37 that aligns with opening 34 through bezel 6 when assembled. The adhesive pad 16 substantially conforms to the shape and size of lower surface 36 of flange 35 of bezel 6. In a preferred embodiment, cover 5 and bezel 6 are made of a polycarbonate material, and the foam retainer 12 is made of a resilient urethane foam with acrylic adhesive on the upper and lower surfaces 24 and 25 of foam retainer 12, respectively, that resiliently attaches circuit board assembly 14 to housing 5.

With further reference to FIGS. 4-7 when detachable upper assembly 10 is assembled, outer peripheral edges 41 of circuit board 28 are closely received against vertical locating surfaces 42 of guide/support members 38 to position circuit board assembly 14 relative to the bezel 6 in the plane of the glass 7. Each sidewall portion 33 of bezel 6 includes two guide/support members 38 that are configured to slidably contact edge portions 43 (see also FIG. 2) of circuit board 28 during assembly of detachable upper assembly 10 with bezel assembly 11 to accurately guide and position the circuit board 28 relative to bezel 6 as circuit board 28 is brought into engagement with bezel 6. When electrical unit 2 is assembled. lower surface 32 of circuit board 28 contacts upper edges 44 of sidewalls 33 to vertically position the Circuit board 28 relative to glass 7, and foam retainer 12 is compressed somewhat, and therefore generates a biasing force pushing circuit board 28 into contact with edges 44 of sidewalls 33. Also, foam retainer 12 provides for some side-to-side movement of circuit board 28 relative to cover 5. and therefore permits the edge portions 43 of circuit board 28 to contact edges 42 of guide/support members 38 to accurately position circuit board 28 and antenna feed wire 31 relative to bezel 6 and conductive antenna element 8, even if cover 5 is somewhat out of position in a side-to-side direction relative to bezel 6 and conductive element 8. Snap connectors 40 are received in notches 45 in cover 5 to thereby retain cover 5 to bezel 6. A notch 46 (FIG. 2) in cover 5 receives a screw driver or the like for removal of cover 5 and detachable upper assembly 10.

During assembly. the circuit board assembly 14 (including shield 13) is secured to foam retainer 12 utilizing adhesive, and foam retainer 12 is secured to cover 5 utilizing adhesive. Cover 5 is then attached to bezel 6. During assembly, tapered end surfaces 39 of guide/support members 38 contact edge portions 43 of circuit board 28 if circuit board 28 is not properly aligned with bezel 6, and the circuit board 28 is thereby guided into the proper alignment with bezel 6 as the circuit board 28 and bezel 6 are brought together. When fully assembled, lower surface 32 of circuit board 28 contacts edge portions 44 of guide/support members 38 to vertically position circuit board 28 and edge portions 43 of circuit board 28 contact edges 42 of guide/support members 38 to horizontally position circuit board 28 and antenna feed wire element 31 relative to bezel 6 and conductive antenna element 8. It will be understood that the distance between opposite edge surfaces 42 is equal to or slightly greater than the distance between opposite edge portions 43 of circuit board 28, such that there may be very small gaps between some of the edge portions 42 of guide/support members 38 and edge portions 43 of circuit board 28. Also, as discussed above, foam retainer 12 is resilient and therefore allows the circuit board 28 to shift side-to-side somewhat so that circuit board 28 can seat properly against edges 42 and 44 of guide/supports 38, and thereby properly and accurately position circuit board 28 and antenna feed wire element 31 relative to bezel 6 and antenna element 8 on glass 7.

The upper assembly 10 and bezel 6 are inverted and cavity 47 bounded by lower surface 32 of circuit board 28 and sidewalls 33 is filled with liquid dielectric material to encapsulate antenna lead wire 31. The dielectric material is then cured to form a solid member 15 encapsulating antenna lead wire 31. Although various dielectric materials may be utilized, in the illustrated example, the dielectric material is alumina filled silicone that is cured by heating the assembly. Adhesive pad 16 is positioned on lower surface 36 of flange 35, and the electrical unit 2 is then adhesively secured to vehicle glass 7 in the proper position relative to the conductive antenna elements 8 on vehicle glass 7. Outer edge 48 of flange 35 protrudes beyond sidewall 21 of cover 5, and thereby provides a surface that can be utilized by a robotic tool or the like to accurately position bezel 6 relative to vehicle glass 7 during assembly.

Figure 8:
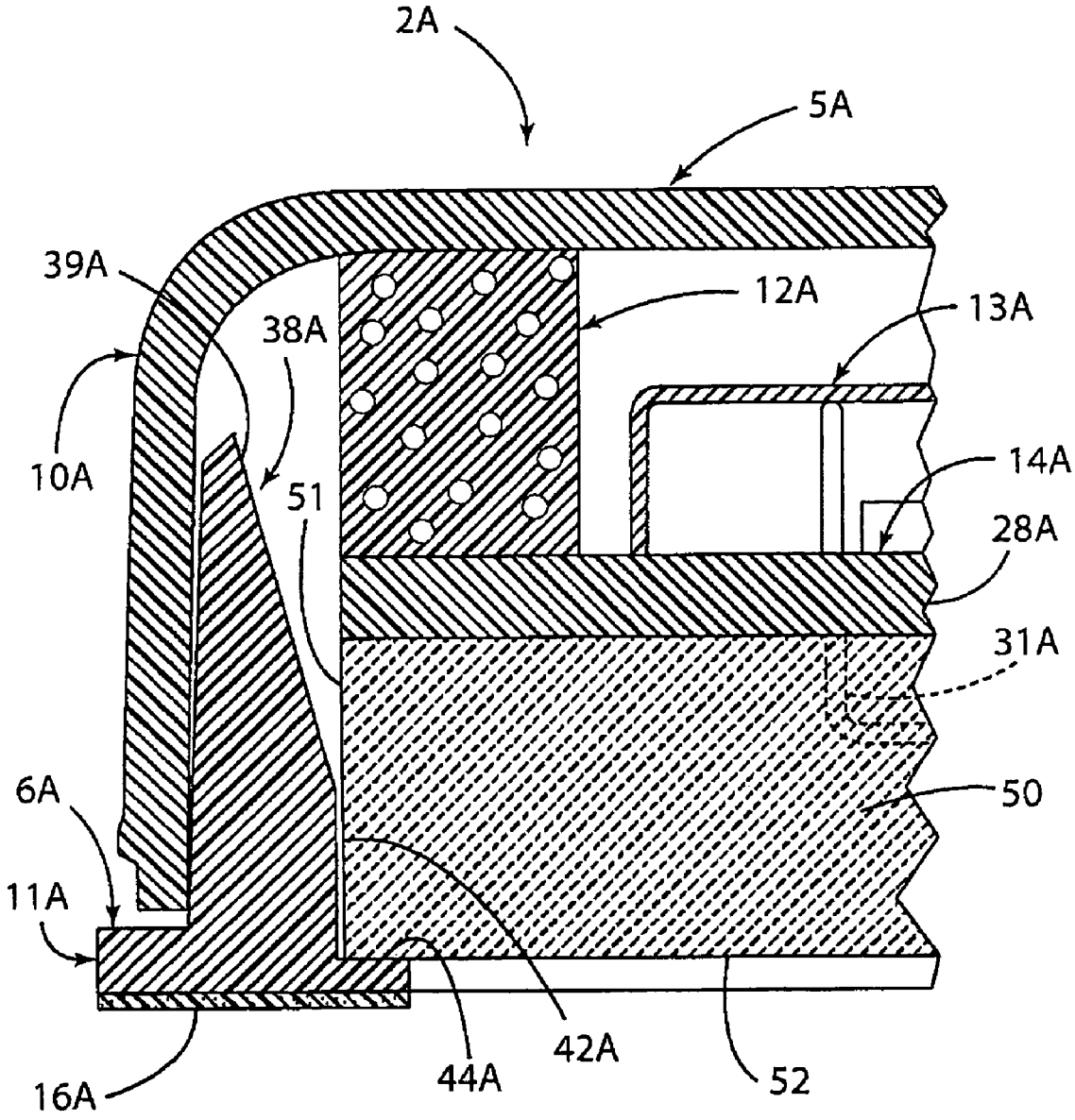
FIG. 8 is a fragmentary cross-sectional view of an antenna system according to another aspect of the present invention wherein dielectric material contacts a bezel to position the circuit board and antenna lead wire.

With further reference to FIG 8, an electrical unit 2A according to another aspect of the present invention includes a cover 5A, foam retainer 12A, circuit board assembly 14A, and shield 13A. Bezel 6A includes tapered end surfaces 39A with locating surfaces 42A and upper support surface 44A. Dielectric material 50 is formed around antenna lead wire 31A to thereby encapsulate the lead wire 31A. Dielectric material 50 may comprise a pre-formed ceramic material that is adhesively bonded to circuit board 28A prior to assembly of detachable upper assembly 10A to bezel assembly 11A. Dielectric material 50 is preferably a ceramic material that can be formed within high tolerances, and includes precise outer surfaces 51 and 52 that engage surfaces 42A and 44A of guide/support members 38A to thereby accurately position circuit board 28A and antenna lead wire 31A relative to bezel 6A. Bezel 6A is secured to vehicle glass 7 utilizing an adhesive pad 16A that is substantially similar to the adhesive pad 16 described in detail above.

If antenna system 1 needs to be serviced after it has been installed to the glass 7 of a vehicle, the detachable upper assembly 10 can be removed by inserting a screw driver (not shown) into notch 46 to thereby pry cover 5 apart from bezel 6 and release snap connectors 40. A new (replacement) detachable upper assembly 10 can then be installed to bezel 6. Tapered end surfaces 39 of guide/support members 38 ensure that the circuit board 28 and antenna feed wire 31 are guided and supported in the proper position wherein circuit board 28 is supported and/or positioned by edges 42 and 44 of bezel 6, and biased into contact with edges 44 by resilient foam retainer 12. The positioning features of bezel 6, along with foam retainer 12, ensure accurate positioning of circuit board 28 and antenna feed wire 31 of upper assembly 10 relative to bezel 6 and antenna element 8 by service personnel, without requiring specialized mounting procedures, tools, or the like. Because the bezel 6 is permanently attached to the vehicle glass 7, the position of the bezel 6 does not change, and the replacement circuit board and antenna feed wire are thereby properly positioned relative to the conductive antenna elements 8 on the vehicle glass 7.

The antenna mounting arrangement of the present invention provides for accurate positioning of the antenna feed wire and circuit board relative to the conductive elements on the vehicle glass during both initial assembly and during servicing of the antenna system. The design of the bezel and circuit board reduces the number of parts utilized to position the circuit board and antenna feed wire, thereby reducing the number of parts and resulting difficulty in maintaining tolerance that would otherwise occur if more parts were utilized in the assembly.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A high frequency capacitive coupling antenna system for motor vehicles, comprising:

a generally planar conductive antenna element adapted to be fixed to a non-conductive component of a vehicle;

a bezel having a mounting surface configured to fixedly position the bezel relative to a surface of the non-conductive component of a vehicle and the conductive antenna element, the bezel further including a support surface;

a circuit board assembly having a board structure and electrical circuit elements mounted to the board structure;

an antenna feed wire electrically connected to the electrical circuit elements, wherein at least a portion of the feed wire extending away from the circuit board towards the conductive antenna element, wherein the antenna feed wire is spaced apart from the conductive antenna element without directly contacting the conductive antenna element;

dielectric material encapsulating the antenna feed wire;

a housing removably connected to the bezel;

a resiliently compressible member secured to the housing and sandwiched between the circuit board and the housing, and wherein:

the circuit board is secured to the resiliently compressible member, and the resiliently compressible member biases the circuit board into contact with the support surface of the bezel and positions the circuit board and antenna feed wire relative to the bezel, wherein the bezel includes a plurality of tapered guide surfaces adjacent the support surface, wherein the circuit board is generally planar and defines a peripheral edge, a lower surface adjacent the peripheral edge, and an axis perpendicular to the circuit board, wherein the lower surface of the circuit board contacts the support surface, and the guide surfaces extend away from the support surface at an acute angle relative to the axis, and wherein the bezel comprises an upstanding wall having upper and lower edges and inner and outer surfaces, the bezel further including a flange extending transversely outward from the lower edge, the flange having a lower surface with adhesive disposed thereon to define the mounting surface.

2. The antenna system of claim 1, wherein:

the circuit board defines an upper side and a lower side, and the resiliently compressible member is secured to the upper side of the circuit board.

3. The antenna system of claim 1, wherein:

the inner and outer surfaces of the upstanding wall have a generally quadrilateral shape.

4. The antenna system of claim 3, wherein:

the housing comprises a generally quadrilateral web disposed parallel to the circuit board, the housing including sidewalls extending transverse to the web and overlapping the upstanding wall of the bezel.

5. The antenna system of claim 4. wherein:

the sidewalls of the housing define an outer surface; and portions of the flange protrude outwardly beyond the outer surface to form assembly surfaces that can be utilized to position the bezel for mounting to a vehicle surface.

6. The antenna system of claim 1, wherein:

the peripheral edge of the circuit board seals against an inner surface of the housing; and the dielectric material is placed in the housing when in a liquid form, and sets to form a solid mass.

7. The antenna system of claim 1, wherein:

the resiliently compressible member comprises foam.

8. The antenna system of claim 7, wherein:

the resiliently compressible member is general ring-shaped.

9. The antenna system of claim 1, wherein:

the housing, circuit board, antenna feed wire, resiliently compressible member and dielectric material comprise an assembly that can be detached from the bezel as a unit for servicing.

10. The antenna system of claim 1, including:

an electrically conductive shield member covering the electrical circuit elements.

11. The antenna system of claim 1, wherein:

the housing and bezel are made of a polymer material.

12. An antenna system for vehicles, comprising:

a bezel having a mounting surface, guide surfaces, adjacent at least one support surface, adhesive disposed on the mounting surface;

a circuit board having electrical circuit elements mounted to a board structure;

an antenna feed wire extending from the circuit board, and dielectric material encapsulating at least a portion of the antenna feed wire, wherein the dielectric material contacts the support surface of the bezel to thereby position the antenna feed wire relative to the support surface of the bezel, wherein the circuit board is generally planar and defines a peripheral edge, a lower surface adjacent the peripheral edge and an axis that is perpendicular to the circuit board; and the guide surfaces comprise at least four guide surfaces, each extending outwardly away from the circuit board at an acute angle relative to the axis, wherein the bezel comprises an upstanding wall having upper edge, lower edge, inner surface and outer surface, wherein the lower surface of the circuit board contacts the upper edge of the upstanding wall, the bezel further including a flange extending transversely outward from the lower edge, the flange having a lower surface with adhesive disposed thereon to define the mounting surface.

13. The antenna system of claim 12, wherein:

the circuit board defines a generally quadrilateral peripheral edge having four side portions; and the guide surfaces comprise eight surfaces, with two guide surfaces positioned adjacent each side portion of the peripheral edge of the circuit board.

14. The antenna system of claim 12, wherein:

each guide surface comprises a web extending transverse to the circuit board, each web including a positioning edge surface in close proximity to a peripheral edge of the circuit board to substantially prevent movement of the circuit board relative to the bezel in the plane of the circuit board.

15. The antenna system of claim 14, wherein:

each web comprises a tapered edge portion extending away from the positioning edge surface at an acute angle relative to the axis.

16. The antenna system of claim 12, wherein:

the dielectric material contacts the mounting surface of the bezel.

* * * * *